US012605001B2

(12) United States Patent
Orellana

(10) Patent No.: US 12,605,001 B2
(45) Date of Patent: Apr. 21, 2026

(54) TWIN CHAMBER MUG DEVICE

(71) Applicant: Erick Orellana, Lombard, IL (US)

(72) Inventor: Erick Orellana, Lombard, IL (US)

( * ) Notice: Subject to any disclaimer, the term of this patent is extended or adjusted under 35 U.S.C. 154(b) by 60 days.

(21) Appl. No.: 18/632,051

(22) Filed: Apr. 10, 2024

(65) Prior Publication Data

US 2025/0318671 A1 Oct. 16, 2025

(51) Int. Cl.

| | |
|---|---|
| ***A47G 19/22*** | (2006.01) |
| ***B65D 23/10*** | (2006.01) |
| ***B65D 25/04*** | (2006.01) |
| ***B65D 43/02*** | (2006.01) |
| *A47G 19/12* | (2006.01) |

(52) U.S. Cl.

CPC ..... *A47G 19/2288* (2013.01); *B65D 23/10* (2013.01); *B65D 25/04* (2013.01); *B65D 43/02* (2013.01); *A47G 2019/122* (2013.01); *B65D 2543/00046* (2013.01)

(58) Field of Classification Search

CPC ..... A47G 19/2288; B65D 81/3837; B65D 81/3865; B65D 81/3841; B65D 81/3869; B65D 43/08

USPC ..... 220/592.17, 592.16, 525, 741

See application file for complete search history.

(56) References Cited

U.S. PATENT DOCUMENTS

| | | | | |
|---|---|---|---|---|
| 8,844,316 | B1 | 9/2014 | Ademola | |
| D736,565 | S | 8/2015 | Wright | |
| 9,120,599 | B2 | 9/2015 | Shamoon | |
| 9,718,582 | B2 | 8/2017 | Hylton | |
| 9,872,587 | B1 | 1/2018 | DiPaolo | |
| D872,596 | S | 1/2020 | Shakeri Clark | |
| 11,639,247 | B2 | 5/2023 | Burden | |
| 2012/0285969 | A1* | 11/2012 | Kelly | B65D 47/265 220/523 |
| 2015/0144516 | A1* | 5/2015 | Shamoon | B65D 25/04 206/459.1 |
| 2016/0114937 | A1* | 4/2016 | Hylton | B65D 47/0857 206/519 |
| 2017/0096258 | A1* | 4/2017 | Seiders | B65D 81/3806 |
| 2019/0231102 | A1* | 8/2019 | Dahab | A47J 41/024 |
| 2021/0030176 | A1 | 2/2021 | Burden | |
| 2024/0092535 | A1* | 3/2024 | Bram | B65D 47/286 |

FOREIGN PATENT DOCUMENTS

| | | |
|---|---|---|
| WO | WO2009032837 | 3/2009 |

* cited by examiner

*Primary Examiner* — Robert Poon

(57) ABSTRACT

A twin chamber mug device for containing a pair of fluid beverages includes a mug which has a dividing wall defining a first interior space of the mug and a second interior space of the mug which can each contain a fluid beverage. The dividing wall is comprised of a thermally insulating material to inhibiting thermal communication between the first interior space and the second interior space. A lid is removably attachable to the mug which has a first drinking hole and a second drinking hole. The first drinking hole is positionable over the first interior space of the mug and the second drinking hole is positionable over the second interior space of the mug. A cover is rotatably attached to the lid which can close either the first drinking hole or the second drinking hole.

9 Claims, 7 Drawing Sheets

TWIN CHAMBER MUG DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to mug devices and more particularly pertains to a new mug device for containing two fluid beverages. The device includes a mug which has a dividing wall to define a first interior space in the mug and a second interior space in the mug which can each contain a respective fluid beverage. The device includes a lid that is removably attachable to the mug which has a first drinking hole and a second drinking hole that are each positionable over a respective first drinking hole and second drinking hole. The device includes a cover which is pivotally attached to the lid that can close either the first drinking hole or the second drinking hole. In this way a user can consume the fluid beverage in either the first interior space or the second interior space.

(2) Description of Related Art Including Information Disclosed Under 37 CFR 1.97 and 1.98

The prior art relates to mug devices including a variety of beverage mug devices that each includes a mug and a dividing wall to define a pair of interior spaces in the mug which can each contain a respective fluid beverage and which each includes a lid that is positionable on the mug to close the pair of interior spaces which has a pair of drinking holes for drinking a respective fluid beverage. The prior art discloses a variety of beverage mug devices that each includes a mug and a dividing wall to define a pair of interior spaces in the mug which can each contain a respective fluid beverage and which each includes a lid which has a pair of drinking straws that extend into a respective interior space for drinking the fluid beverage in the respective interior space. In no instance does the prior art disclose a beverage mug device that includes a mug with a dividing wall that defines a pair of interior spaces in the mug which can each contain a respective fluid beverage and a lid that has a pair of drinking holes and a cover pivotally attached to the lid which is positionable to cover one of the pair of drinking holes.

BRIEF SUMMARY OF THE INVENTION

An embodiment of the disclosure meets the needs presented above by generally comprising a mug which has a dividing wall defining a first interior space of the mug and a second interior space of the mug which can each contain a fluid beverage. The dividing wall is comprised of a thermally insulating material to inhibiting thermal communication between the first interior space and the second interior space. A lid is removably attachable to the mug which has a first drinking hole and a second drinking hole. The first drinking hole is positionable over the first interior space of the mug and the second drinking hole is positionable over the second interior space of the mug. A cover is rotatably attached to the lid which can close either the first drinking hole or the second drinking hole.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
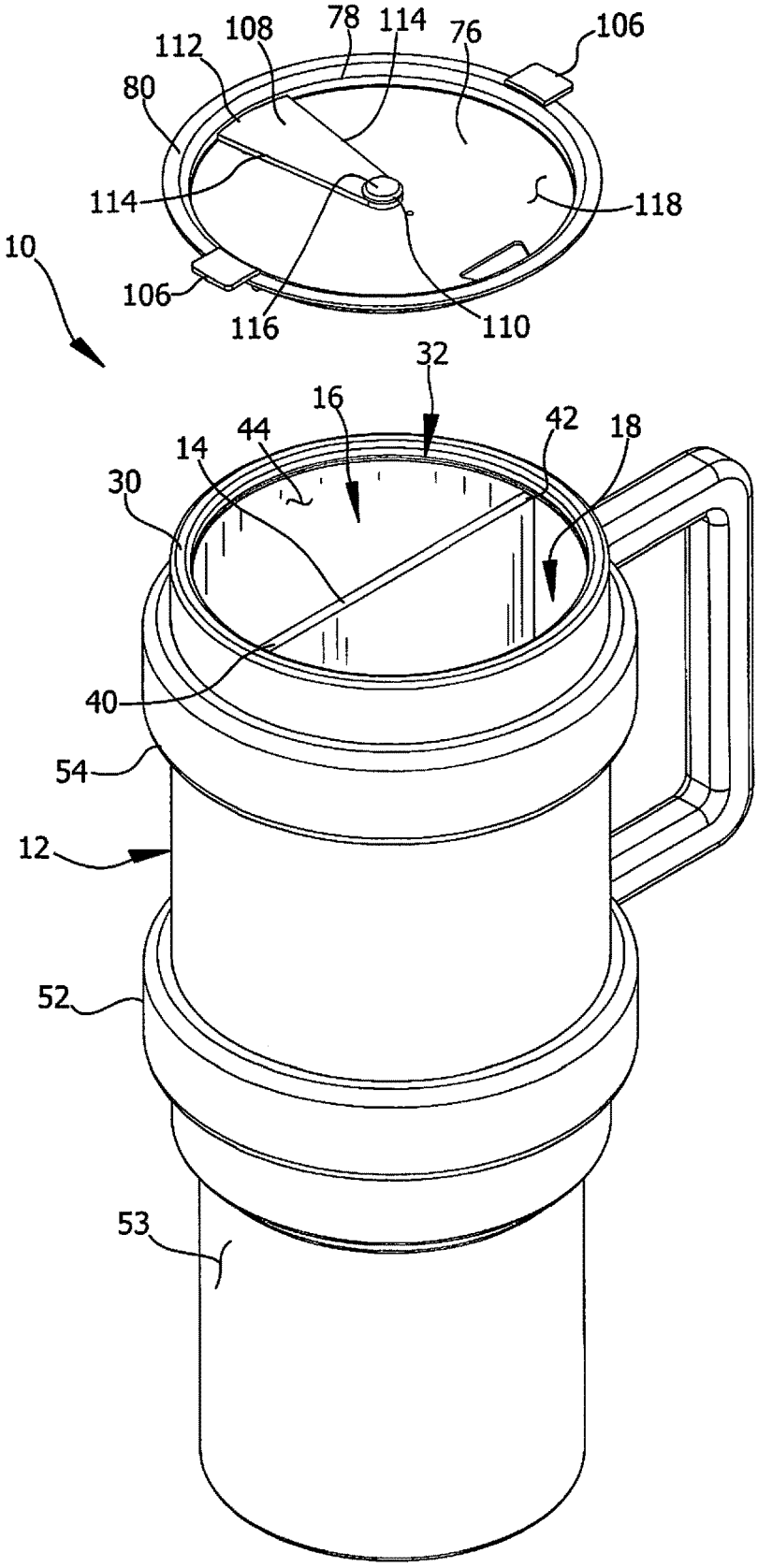
FIG. 1 is a top perspective view of a twin chamber mug device according to an embodiment of the disclosure.
Figure 2:
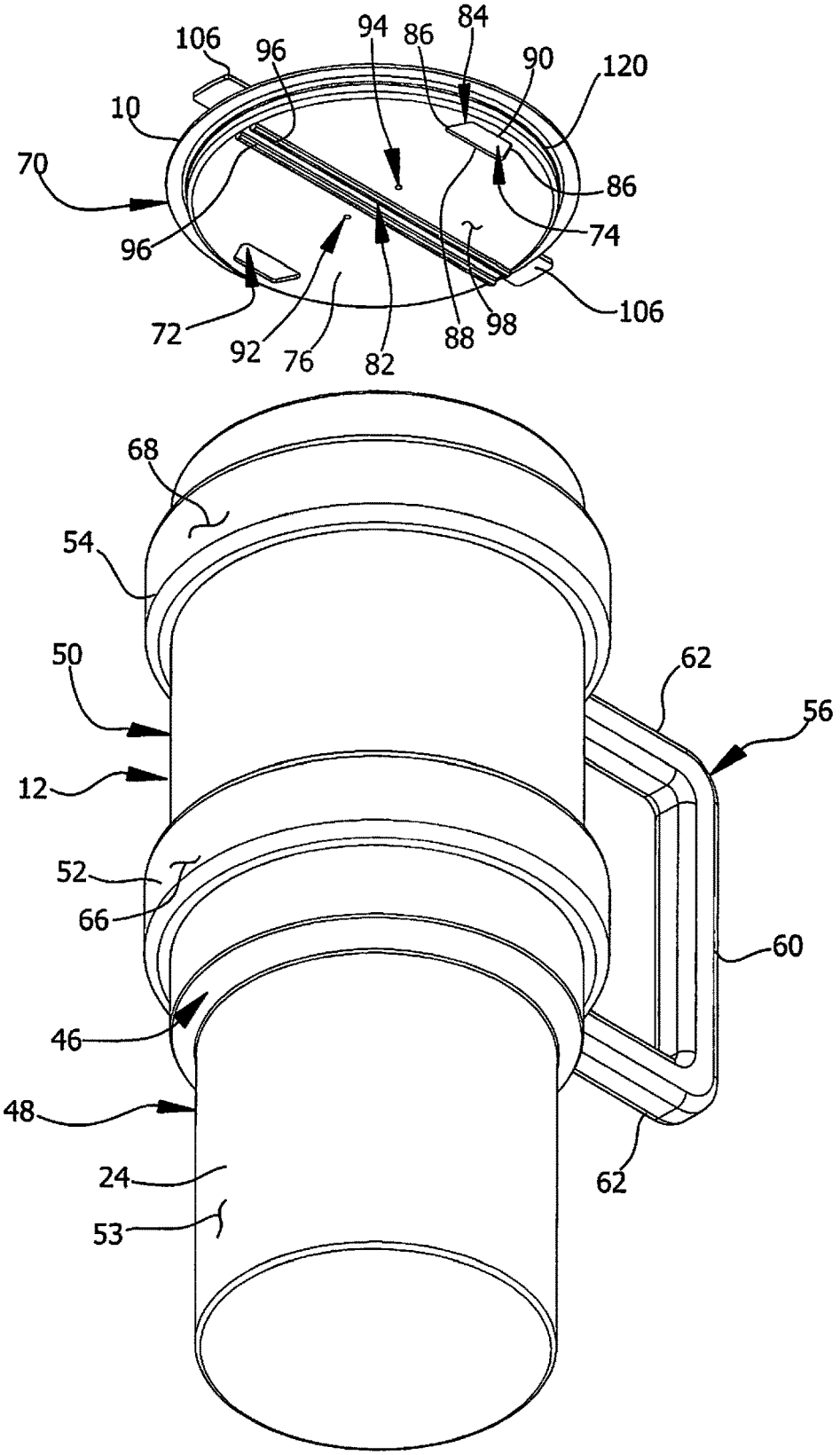
FIG. 2 is a bottom perspective view of an embodiment of the disclosure.
Figure 3:
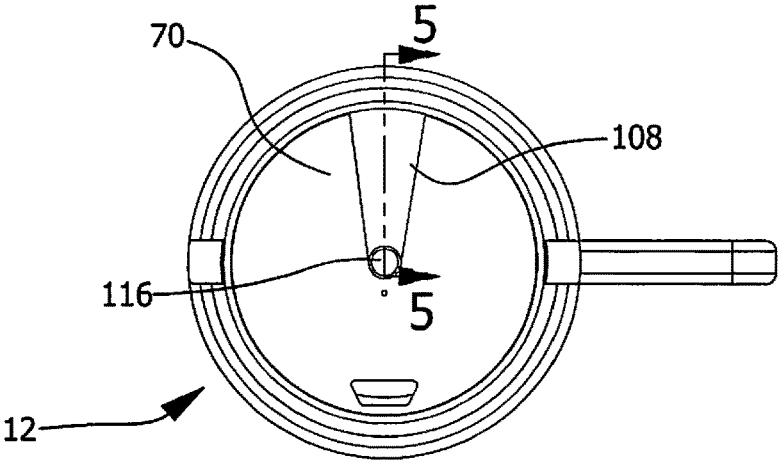
FIG. 3 is a top view of an embodiment of the disclosure.
Figure 4:
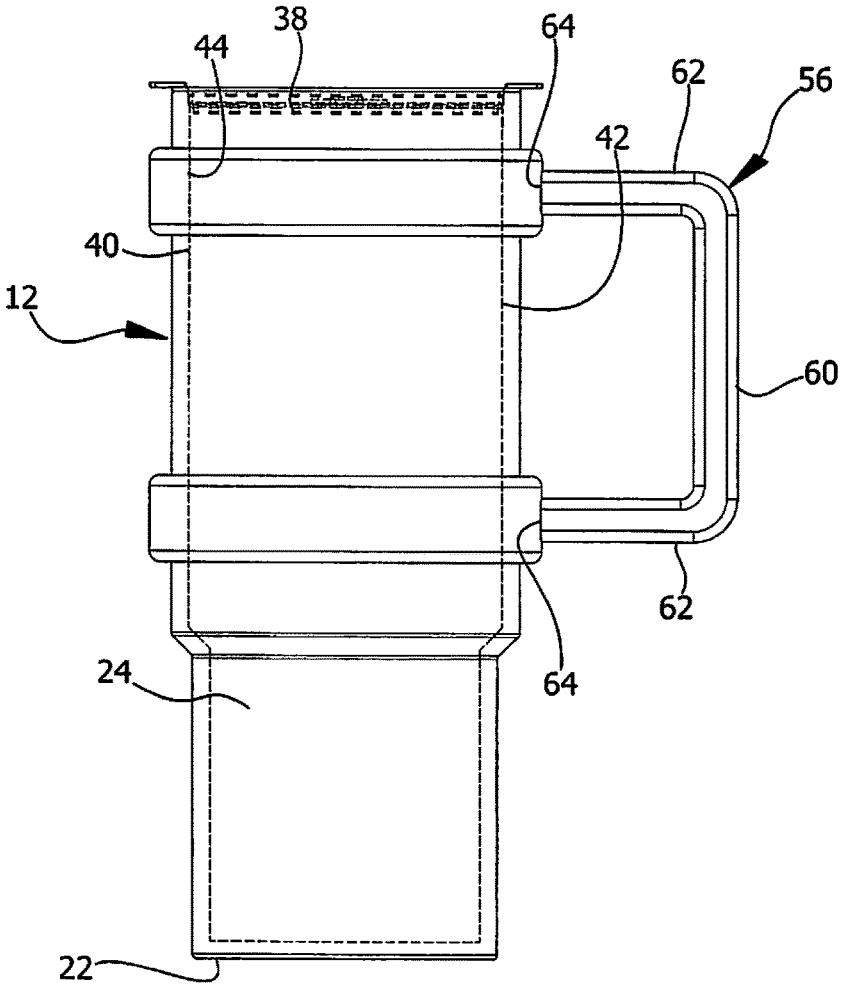
FIG. 4 is a left side phantom view of an embodiment of the disclosure.
Figure 5:
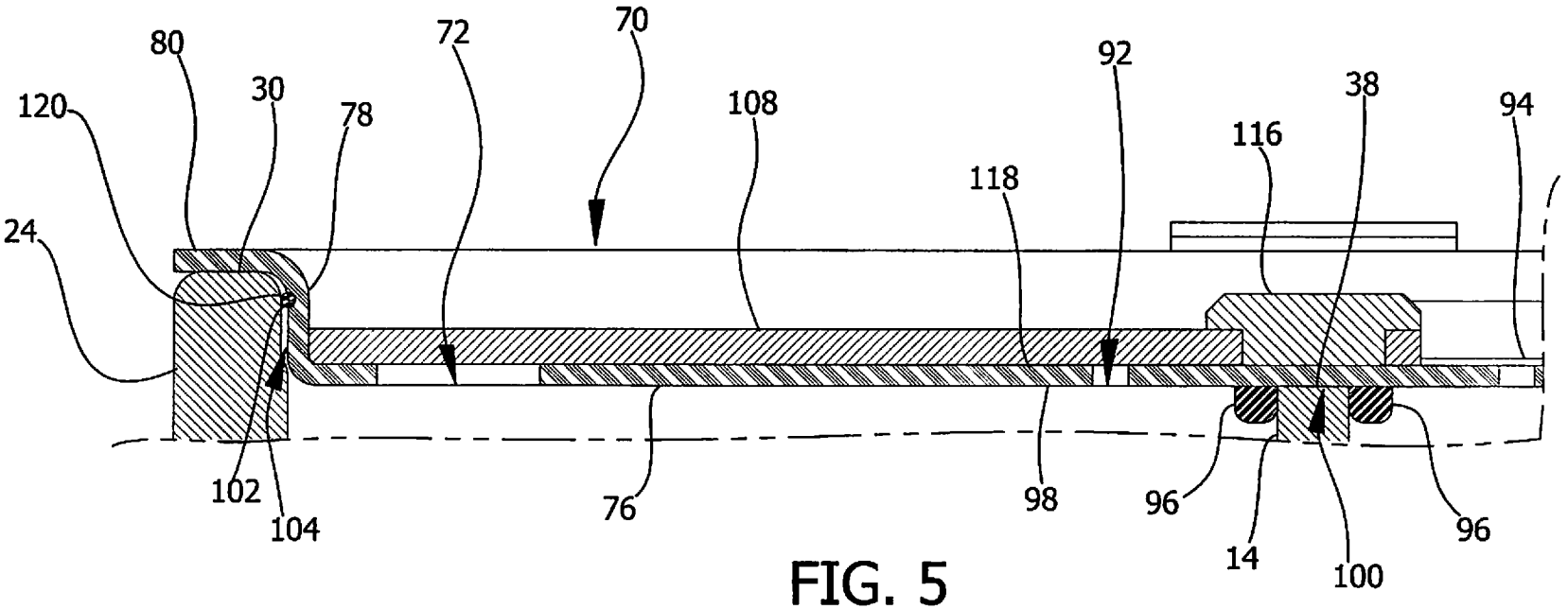
FIG. 5 is a cross sectional view taken along line 5-5 of FIG. 3 of an embodiment of the disclosure.
Figure 6:
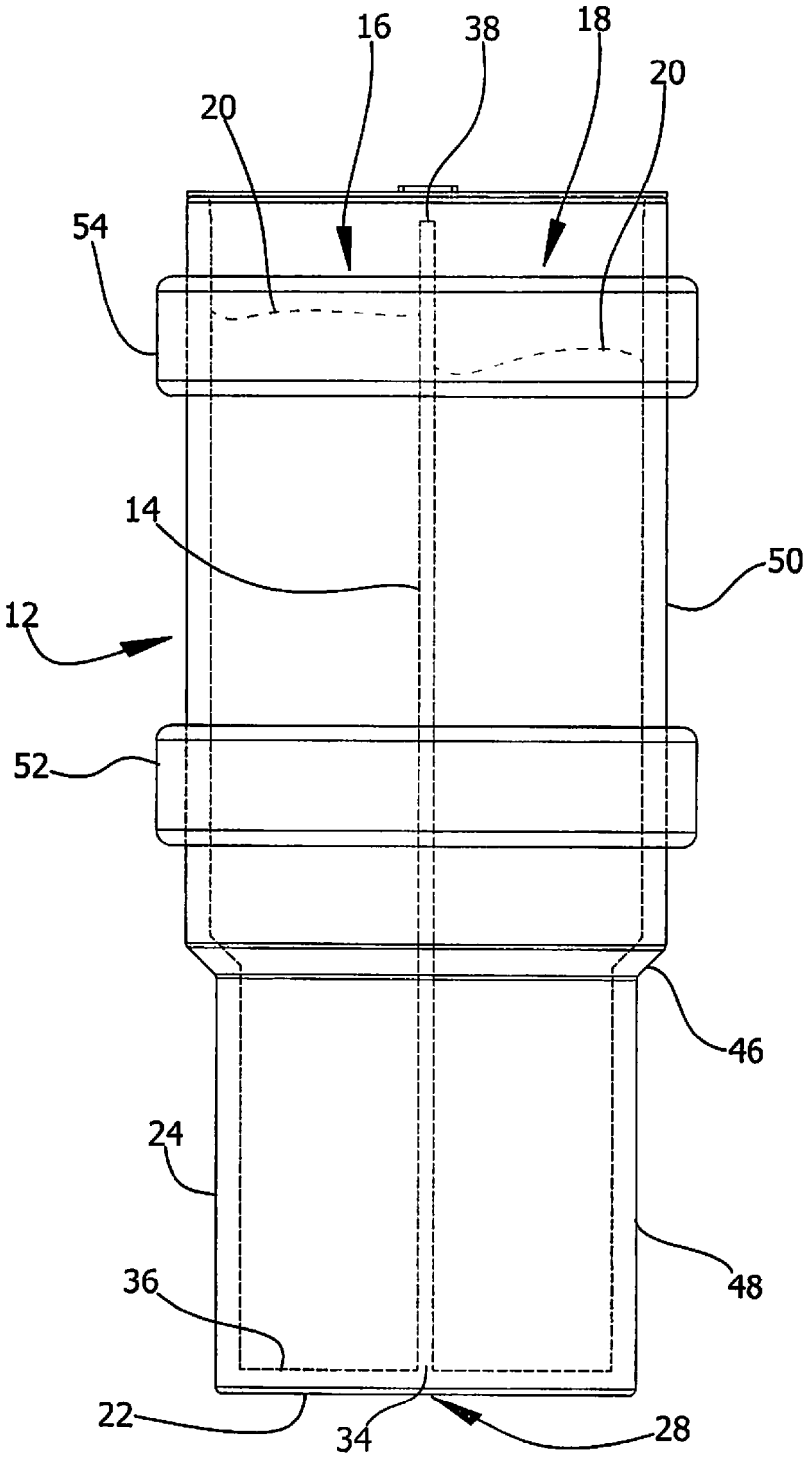
FIG. 6 is a front phantom view of an embodiment of the disclosure.
Figure 7:
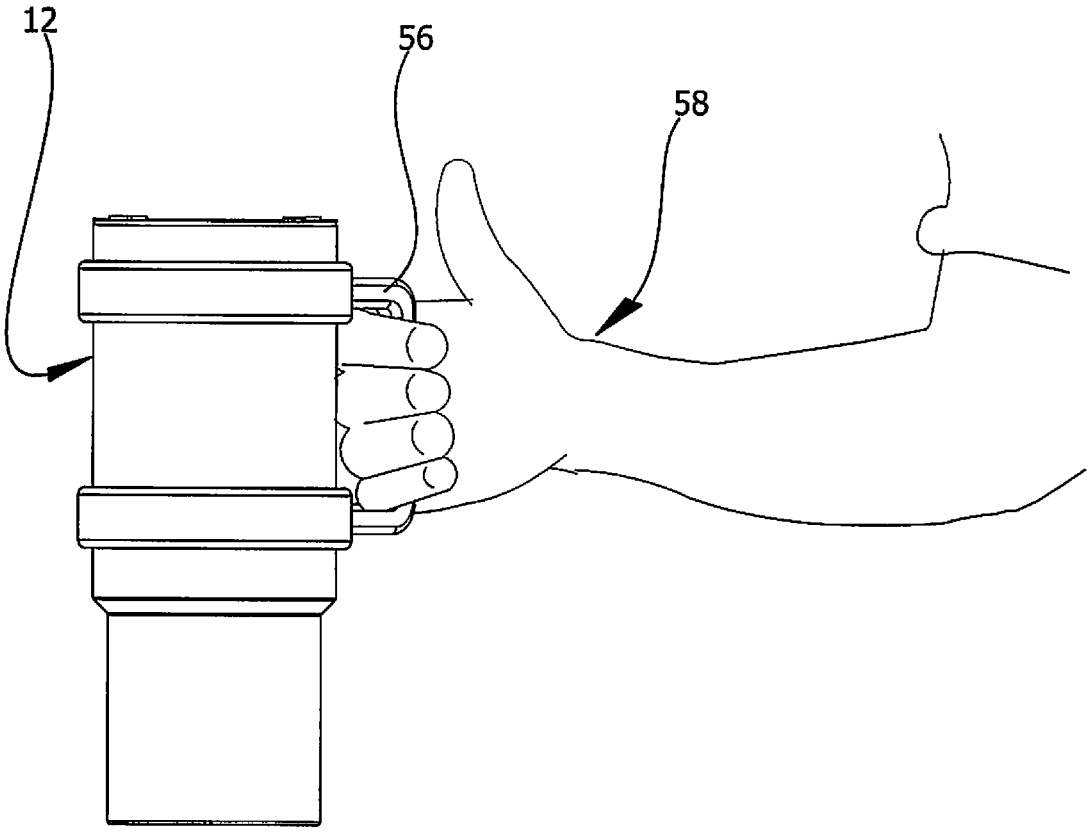
FIG. 7 is a perspective in-use view of an embodiment of the disclosure showing user holding a handle of a mug.

With reference now to the drawings, and in particular to FIGS. 1 through 8 thereof, a new mug device embodying the principles and concepts of an embodiment of the disclosure and generally designated by the reference numeral 10 will be described.

As best illustrated in FIGS. 1 through 8, the twin chamber mug device 10 generally comprises a mug 12 which has a dividing wall 14 that is disposed within the mug 12 thereby defining a first interior space 16 of the mug 12 that is fluidly discrete from a second interior space 18 of the mug 12. Furthermore, each of the first interior space 16 and the second interior space 18 can contain a fluid beverage 20. The dividing wall 14 is comprised of a thermally insulating material thereby inhibiting thermal communication between the first interior space 16 and the second interior space 18. In this way the dividing wall 14 facilitates fluid beverages 20 of different temperatures to be contained in a respective one of the first interior space 16 and the second interior space 18. The fluid beverages 20 may include a hot beverage, including but not being limited to coffee or tea, and the fluid beverages 20 may include a cold beverage, including but not being limited to water or juice.

The mug 12 has a bottom wall 22 and an outer wall 24 extending upwardly from a perimeter edge 26 of the bottom wall 22 and the outer wall 24 is continuously arcuate about a center 28 of the bottom wall 22 such that the mug 12 has a cylindrical shape. The outer wall 24 has an upper edge 30 which defines an opening 32 into each of the first interior space 16 and the second interior space 18. The dividing wall 14 has a bottom end 34 which is coupled to a top surface 36 of the bottom wall 22 and the dividing wall 14 has a top edge 38 which is spaced downwardly from the upper edge 30 of the outer wall 24. Additionally, the dividing wall 14 is centrally located on the top surface 36 of the bottom wall 22 having the dividing wall 14 bisecting the opening 32 defined by the upper edge 30 of the outer wall 24 such that the first interior space 16 has a volume which is equal to a volume of the second interior space 18. The dividing wall 14 has a first lateral edge 40 and a second lateral edge 42 which is each coupled to an interior surface 44 of the outer wall 24 thereby facilitating the first interior space 16 to be fluidly discrete from the second interior space 18. Each of the outer wall 24 and the bottom wall 22 is comprised of a thermally insulating material to inhibit thermal communication between ambient air and the fluid beverage 20 contained in each of the first interior space 16 and the second interior space 18.

The outer wall 24 has a middle portion 46 angling outwardly between a lower portion 48 and an upper portion 50 of the outer wall 24 such that the lower portion 48 has a diameter which is less than a diameter of the upper portion 50. Additionally, the middle portion 46 is positioned closer to the bottom wall 22 than the upper edge 30 of the outer wall 24. The mug 12 has a first annular ring 52 extending around an exterior surface 53 of the outer wall 24 and the first annular ring 52 is positioned on the upper portion 50 of the outer wall 24. Furthermore, the first annular ring 52 is positioned closer to the middle portion 46 of the outer wall 24 than the upper edge 30 of the outer wall 24. The mug 12 has a second annular ring 54 extending around the exterior surface 53 of the outer wall 24 and the second annular ring 54 is positioned on the upper portion 50 of the outer wall 24. Furthermore, the second annular ring 54 is positioned closer to the upper edge 30 of the outer wall 24 than the first annular ring 52.

Figure 8:
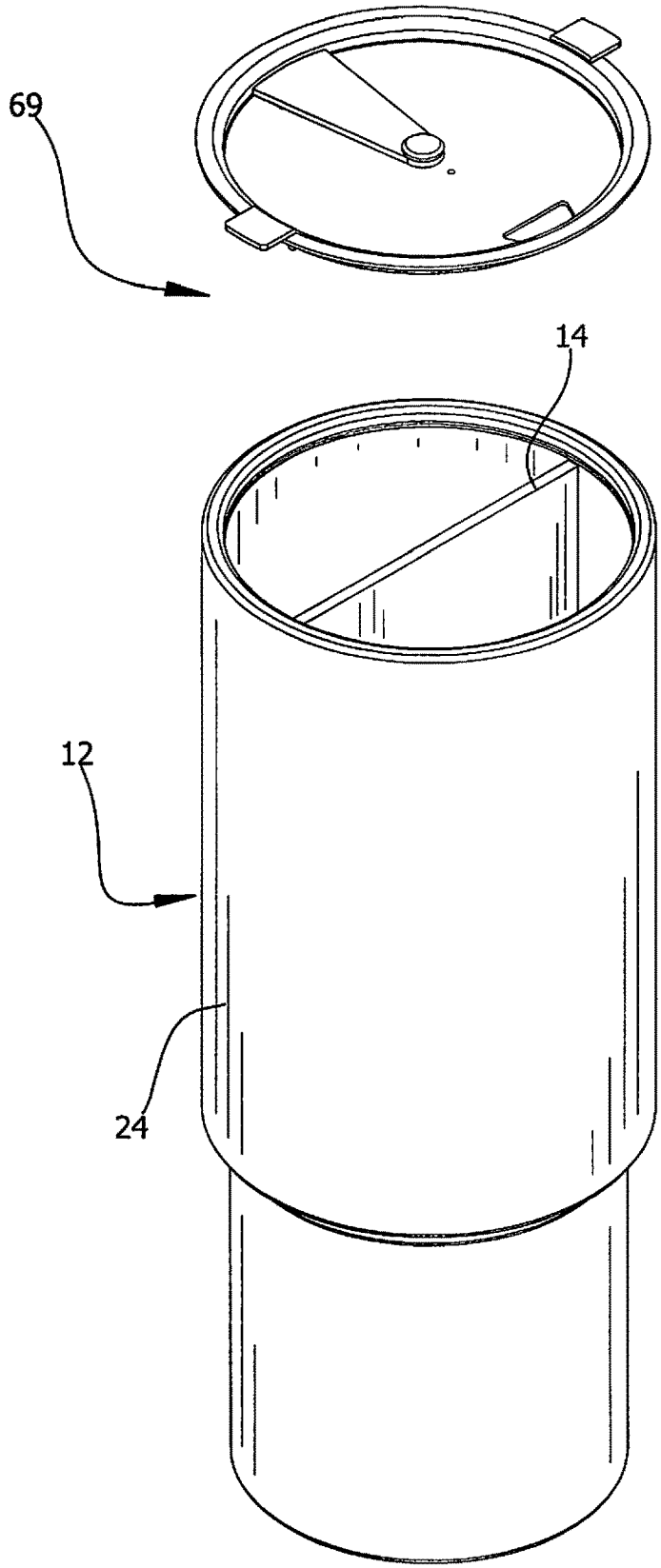
FIG. 8 is a perspective view of an alternative embodiment of the disclosure.

A handle 56 is attached to the mug 12 and the handle 56 can be gripped by a user 58 for holding the mug 12. The handle 56 has a central member 60 extending between a pair of end members 62 and each of the end members 62 is spaced apart from each other and is perpendicularly oriented with the central member 60 such that the handle 56 has a U-shape. Each of the pair of end members 62 has a distal end 64 with respect to the central member 60 and the distal end 64 of a respective one of the pair of end members 62 is coupled to an outwardly facing surface 66 of the first annular ring 52. The distal end 64 of a respective one of the pair of end members 62 is coupled to an outwardly facing surface 68 of the second annular ring 54. Additionally, the central member 60 is spaced from and is oriented parallel to the exterior surface 53 of the outer wall 24 wherein the central member 60 is configured to be gripped by the user 58. In an alternative embodiment 69 as shown in FIG. 8, each of the first annular ring 52 and the second annular ring 54 and the handle 56 are absent from the mug 12.

A lid 70 is provided and the lid 70 is removably attachable to the mug 12. The lid 70 has a first drinking hole 72 extending through the lid 70 to pass fluid through the lid 70. The lid 70 has a second drinking hole 74 extending through the lid 70 to pass fluid through the lid 70. The first drinking hole 72 is positionable over the first interior space 16 of the mug 12 when the lid 70 is removably attached to the mug 12 to facilitate the user 58 to drink the fluid beverage 20 contained in the first interior space 16. Additionally, the second drinking hole 74 is positionable over the second interior space 18 of the mug 12 when the lid 70 is removably attached to the mug 12 to facilitate the user 58 to drink the fluid beverage 20 contained in the second interior space 18.

The lid 70 has a basal wall 76 and a perimeter wall 78 extending upwardly from the basal wall 76 and a lip 80 extending away from the perimeter wall 78. The lip 80 extends around a full circumference of the perimeter wall 78 having the lip 80 lying on a plane which is oriented parallel to the basal wall 76. Each of the first drinking hole 72 and the second drinking hole 74 extends through the basal wall 76 and each of the first drinking hole 72 and the second drinking hole 74 is positioned closer to the perimeter wall 78 than a center 82 of the basal wall 76. Each the first drinking hole 72 and the second drinking hole 74 has a bounding edge 84 which has a pair of lateral sides 86 each angling outwardly between a front side 88 and a back side 90 such that each of the first drinking hole 72 and the second drinking hole 74 has a trapezoidal shape. Furthermore, the back side 90 of the bounding edge 84 of each of the first drinking hole 72 and the second drinking hole 74 is directed toward the perimeter wall 78 of the lid 70. Each of the first drinking hole 72 and the second drinking hole 74 is positioned on opposite sides of the basal wall 76 having each of the first drinking hole 72 and the second drinking hole 74 being aligned with each other.

The lid 70 has a first vent hole 92 extending through the basal wall 76 of the lid 70 to pass air through the basal wall 76. The lid 70 has a second vent hole 94 extending through the basal wall 76 of the lid 70 to pass air through the basal wall 76. The lid 70 has a pair of ridges 96 each extending downwardly from a bottom surface 98 of the basal wall 76 of the lid 70 and each of the pair of ridges 96 extends across a full width of the basal wall 76. Additionally, the ridges 96 are spaced apart from each other to define a space 100 between the pair of ridges 96 which bisects the basal wall 76. Furthermore, the space 100 insertably receives the top edge 38 of the dividing wall 14 when the lid 70 is removably attached to the mug 12 to inhibit the fluid beverage 20 in the first interior space 16 from mixing with the fluid beverage 20 in the second interior space 18.

The mug 12 has a recess 102 extending into an outwardly facing surface 104 of the perimeter wall 78 of the lid 70 and the recess 102 extends around a full circumference of the perimeter wall 78. The recess 102 is positioned closer to the lip 80 of the lid 70 than the basal wall 76 of the lid 70.

Additionally, the lid 70 has a pair of tabs 106 each lying on top of the lip 80 of the lid 70 and each of the tabs 106 extends outwardly beyond the lip 80. In this way each of the tabs 106 can be gripped by the user 58 for removing the lid 70 from the mug 12. Furthermore, the tabs 106 are aligned with each other and are positioned on opposite sides of the lip 80 with respect to each other.

A cover 108 is provided and the cover 108 is rotatably attached to the lid 70. The cover 108 is positionable in a first position having the cover 108 being positioned over the first drinking hole 72. In this way the cover 108 inhibits the fluid beverage 20 in the first interior space 16 from passing through the first drinking hole 72. The cover 108 is positionable in a second position having the cover 108 being positioned over the second drinking hole 74. In this way the cover 108 inhibits the fluid beverage 20 in the second interior space 18 from passing through the second drinking hole 74.

The cover 108 has a first end 110 and a second end 112 and a pair of lateral edges 114 each extending between the first end 110 and the second end 112. Each of the pair of lateral edges 114 angles outwardly between the first end 110 and the second end 112 such that the second end 112 has a width which is greater than a width of the first end 110. The cover 108 includes a pivot 116 which is attached to an uppermost surface 118 of the basal wall 76 of the lid 70 having the pivot 116 being centrally positioned on the uppermost surface 118. Additionally, the pivot 116 is located adjacent to the first end 110 of the cover 108 such that the second end 112 of the cover 108 rests against the perimeter wall 78 of the lid 70.

A gasket 120 is positioned in the recess 102 in the outwardly facing surface 104 of the perimeter wall 78 of the lid 70 and the gasket 120 is continuous such that the gasket 120 extends around a full circumference of the recess 102. The gasket 120 abuts the interior surface 44 of the outer wall 24 of the mug 12 when the lid 70 is removably attached to the mug 12. Additionally, the gasket 120 is comprised of a resiliently compressible material such that the gasket 120 forms a fluid impermeable seal with the interior surface 44 of the outer wall 24 of the mug 12. In this way the gasket 120 inhibits the fluid beverage 20 contained in each of the first interior space 16 and the second interior space 18 from escaping the mug 12 when the lid 70 is removably attached to the mug 12.

In use, each of the fluid beverages 20 is poured into a respective one of the first interior space 16 and the second interior space 18 and the lid 70 is removably attached to the lid 70. The cover 108 can be positioned in the first position to facilitate the fluid beverage 20 in the second interior space 18 to be drank through the second drinking hole 74. Conversely, the cover 108 can be positioned in the second position to facilitate the fluid beverage 20 in the first interior space 16 to be drank through the first drinking hole 72. Additionally, the dividing wall 14 inhibits thermal communication between the fluid beverage 20 in the first interior space 16 and the fluid beverage 20 in the second interior space 18. In this way a cold beverage can be contained in the first interior space 16, for example, and a hot beverage can be contained in the second interior space 18, for example.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A twin chamber mug device for discretely containing two beverages of different temperatures to facilitate a user to drink either of the two beverages independently of each other, said device comprising:

a mug having a dividing wall being disposed within said mug thereby defining a first interior space of said mug being fluidly discrete from a second interior space of said mug wherein each of said first interior space and said second interior space is configured to contain a fluid beverage, said dividing wall being comprised of a thermally insulating material thereby inhibiting thermal communication between said first interior space and said second interior space wherein said dividing wall is configured to facilitate fluid beverages of different temperatures to be contained in a respective one of said first interior space and said second interior space;

a handle being attached to said mug wherein said handle is configured to be gripped by a user for holding said mug;

a lid being removably attachable to said mug, said lid having a first drinking hole extending through said lid wherein said first drinking hole is configured to pass fluid through said lid, said lid having a second drinking hole extending through said lid wherein said second drinking hole is configured to pass fluid through said lid, said first drinking hole being positionable over said first interior space of said mug when said lid is removably attached to said mug wherein said first drinking hole is configured to facilitate the user to drink the fluid beverage contained in said first interior space, said second drinking hole being positionable over said second interior space of said mug when said lid is removably attached to said mug wherein said second drinking hole is configured to facilitate the user to drink the fluid beverage contained in said second interior space; and a cover being rotatably attached to said lid, said cover being positionable in a first position having said cover being positioned over said first drinking hole wherein said cover is configured to inhibit the fluid beverage in said first interior space from passing through said first drinking hole, said cover being positionable in a second position having said cover being positioned over said second drinking hole wherein said cover is configured to inhibit the fluid beverage in said second interior space from passing through said second drinking hole;

wherein said lid has a basal wall and a perimeter wall extending upwardly from said basal wall and a lip extending away from said perimeter wall;

wherein said lip extends around a full circumference of said perimeter wall having said lip lying on a plane being oriented parallel to said basal wall;

wherein each of said first drinking hole and said second drinking hole extends through said basal wall;

wherein each of said first drinking hole and said second drinking hole is positioned closer to said perimeter wall than a center of said basal wall;

wherein each said first drinking hole and said second drinking hole has a bounding edge having a pair of lateral sides each angling outwardly between a front side and a back side such that each of said first drinking hole and said second drinking hole has a trapezoidal shape;

wherein said back side of said bounding edge of each of said first drinking hole and said second drinking hole is directed toward said perimeter wall of said lid;

wherein each of said first drinking hole and said second drinking hole is positioned on opposite sides of said basal wall having each of said first drinking hole and said second drinking hole being aligned with each other;

wherein said lid has a first vent hole extending through said basal wall of said lid wherein said first vent hole is configured to pass air through said basal wall; and wherein said lid has a second vent hole extending through said basal wall of said lid wherein said second vent hole is configured to pass air through said basal wall.

2. The device according to claim 1, wherein:

said mug has a bottom wall and an outer wall extending upwardly from a perimeter edge of said bottom wall;

said outer wall is continuously arcuate about a center of said bottom wall such that said mug has a cylindrical shape;

said outer wall has an upper edge defining an opening into each of said first interior space and said second interior space;

said dividing wall has a bottom end being coupled to a top surface of said bottom wall;

said dividing wall has a top edge being spaced downwardly from said upper edge of said outer wall;

said dividing wall is centrally located on said top surface of said bottom wall having said dividing wall bisecting said opening defined by said upper edge of said outer wall such that said first interior space has a volume being equal to a volume of said second interior space;

said dividing wall has a first lateral edge and a second lateral edge each being coupled to an interior surface of said outer wall thereby facilitating said first interior space to be fluidly discrete from said second interior space;

said outer wall has a middle portion angling outwardly between a lower portion and an upper portion of said outer wall such that said lower portion has a diameter being less than a diameter of said upper portion;

said middle portion is positioned closer to said bottom wall than said upper edge of said outer wall; and each of said outer wall and said bottom wall is comprised of a thermally insulating material wherein each of said bottom wall and said outer wall is configured to inhibit thermal communication between ambient air and the fluid beverage contained in each of said first interior space and said second interior space.

3. The device according to claim 2, wherein:

said mug has a first annular ring extending around an exterior surface of said outer wall;

said first annular ring is positioned on said upper portion of said outer wall;

said first annular ring is positioned closer to said middle portion of said outer wall than said upper edge of said outer wall;

said mug has a second annular ring extending around said exterior surface of said outer wall;

said second annular ring is positioned on said upper portion of said outer wall; and said second annular ring is positioned closer to said upper edge of said outer wall than said first annular ring.

4. The device according to claim 3, wherein:

said handle has a central member extending between a pair of end members;

each of said end members is spaced apart from each other and is perpendicularly oriented with said central member such that said handle has a U-shape;

each of said pair of end members has a distal end with respect to said central member;

said distal end of a respective one of said pair of end members is coupled to an outwardly facing surface of said first annular ring;

said distal end of a respective one of said pair of end members is coupled to an outwardly facing surface of said second annular ring; and said central member is spaced from and is oriented parallel to said exterior surface of said outer wall wherein said central member is configured to be gripped by the user.

5. The device according to claim 1, wherein:

said dividing wall has a top edge;

said lid has a pair of ridges each extending downwardly from a bottom surface of said basal wall of said lid;

each of said pair of ridges extends across a full width of said basal wall;

said pair of ridges is spaced apart from each other to define a space between said pair of ridges which bisects said basal wall; and said space insertably receives said top edge of said dividing wall when said lid is removably attached to said mug wherein said pair of ridges is configured to inhibit the fluid beverage in said first interior space from mixing with the fluid beverage in said second interior space.

6. The device according to claim 1, wherein:

said mug has a recess extending into an outwardly facing surface of said perimeter wall of said lid;

said recess extends around a full circumference of said perimeter wall;

said recess is positioned closer to said lip of said lid than said basal wall of said lid;

said lid has a pair of tabs each lying on top of said lip of said lid;

each of said tabs extends outwardly beyond said lip wherein each of said tabs is configured to be gripped by the user for removing said lid from said mug; and said pair of tabs is aligned with each other and is positioned on opposite sides of said lip with respect to each other.

7. The device according to claim 1, wherein:

said cover has a first end and a second end and a pair of lateral edges each extending between said first end and said second end;

each of said pair of lateral edges angles outwardly between said first end and said second end such that said second end has a width being greater than a width of said first end;

said cover includes a pivot being attached to an uppermost surface of said basal wall of said lid having said pivot being centrally positioned on said uppermost surface; and said pivot is located adjacent to said first end of said cover such that said second end of said cover rests against said perimeter wall of said lid.

8. The device according to claim 6, wherein:

said device includes a gasket being positioned in said recess in said outwardly facing surface of said perimeter wall of said lid;

said gasket is continuous such that said gasket extends around a full circumference of said recess;

said gasket abuts said interior surface of said outer wall of said mug when said lid is removably attached to said mug; and said gasket is comprised of a resiliently compressible material such that said gasket forms a fluid impermeable seal with said outer wall of said mug wherein said gasket is configured to inhibit the fluid beverage contained in each of said first interior space and said second interior space from escaping said mug when said lid is removably attached to said mug.

9. A twin chamber mug device for discretely containing two beverages of different temperatures to facilitate a user to drink either of the two beverages independently of each other, said device comprising:

a mug having a dividing wall being disposed within said mug thereby defining a first interior space of said mug being fluidly discrete from a second interior space of said mug wherein each of said first interior space and said second interior space is configured to contain a fluid beverage, said dividing wall being comprised of a thermally insulating material thereby inhibiting thermal communication between said first interior space and said second interior space wherein said dividing wall is configured to facilitate fluid beverages of different temperatures to be contained in a respective one of said first interior space and said second interior space, said mug having a bottom wall and an outer wall extending upwardly from a perimeter edge of said bottom wall, said outer wall being continuously arcuate about a center of said bottom wall such that said mug has a cylindrical shape, said outer wall having an upper edge defining an opening into each of said first interior space and said second interior space, said dividing wall having a bottom end being coupled to a top surface of said bottom wall, said dividing wall having a top edge being spaced downwardly from said upper edge of said outer wall, said dividing wall being centrally located on said top surface of said bottom wall having said dividing wall bisecting said opening defined by said upper edge of said outer wall such that said first interior space has a volume being equal to a volume of said second interior space, said dividing wall having a first lateral edge and a second lateral edge each being coupled to an interior surface of said outer wall thereby facilitating said first interior space to be fluidly discrete from said second interior space, each of said outer wall and said bottom wall being comprised of a thermally insulating material wherein each of said bottom wall and said outer wall is configured to inhibit thermal communication between ambient air and the fluid beverage contained in each of said first interior space and said second interior space, said outer wall having a middle portion angling outwardly between a lower portion and an upper portion of said outer wall such that said lower portion has a diameter being less than a diameter of said upper portion, said middle portion being positioned closer to said bottom wall than said upper edge of said outer wall, said mug having a first annular ring extending around an exterior surface of said outer wall, said first annular ring being positioned on said upper portion of said outer wall, said first annular ring being positioned closer to said middle portion of said outer wall than said upper edge of said outer wall, said mug having a second annular ring extending around said exterior surface of said outer wall, said second annular ring being positioned on said upper portion of said outer wall, said second annular ring being positioned closer to said upper edge of said outer wall than said first annular ring;

a handle being attached to said mug wherein said handle is configured to be gripped by a user for holding said mug, said handle having a central member extending between a pair of end members, each of said end members being spaced apart from each other and being perpendicularly oriented with said central member such that said handle has a U-shape, each of said pair of end members having a distal end with respect to said central member, said distal end of a respective one of said pair of end members being coupled to an outwardly facing surface of said first annular ring, said distal end of a respective one of said pair of end members being coupled to an outwardly facing surface of said second annular ring, said central member being spaced from and being oriented parallel to said exterior surface of said outer wall wherein said central member is configured to be gripped by the user;

a lid being removably attachable to said mug, said lid having a first drinking hole extending through said lid wherein said first drinking hole is configured to pass fluid through said lid, said lid having a second drinking hole extending through said lid wherein said second drinking hole is configured to pass fluid through said lid, said first drinking hole being positionable over said first interior space of said mug when said lid is removably attached to said mug wherein said first drinking hole is configured to facilitate the user to drink the fluid beverage contained in said first interior space, said second drinking hole being positionable over said second interior space of said mug when said lid is removably attached to said mug wherein said second drinking hole is configured to facilitate the user to drink the fluid beverage contained in said second interior space, said lid having a basal wall and a perimeter wall extending upwardly from said basal wall and a lip extending away from said perimeter wall, said lip extending around a full circumference of said perimeter wall having said lip lying on a plane being oriented parallel to said basal wall, each of said first drinking hole and said second drinking hole extending through said basal wall, each of said first drinking hole and said second drinking hole being positioned closer to said perimeter wall than a center of said basal wall, each said first drinking hole and said second drinking hole having a bounding edge having a pair of lateral sides each angling outwardly between a front side and a back side such that each of said first drinking hole and said second drinking hole has a trapezoidal shape, said back side of said bounding edge of each of said first drinking hole and said second drinking hole being directed toward said perimeter wall of said lid, each of said first drinking hole and said second drinking hole being positioned on opposite sides of said basal wall having each of said first drinking hole and said second drinking hole being aligned with each other, said lid having a first vent hole extending through said basal wall of said lid wherein said first vent hole is configured to pass air through said basal wall, said lid having a second vent hole extending through said basal wall of said lid wherein said second vent hole is configured to pass air through said basal wall, said lid having a pair of ridges each extending downwardly from a bottom surface of said basal wall of said lid, each of said pair of ridges extending across a full width of said basal wall, said pair of ridges being spaced apart from each other to define a space between said pair of ridges which bisects said basal wall, said space insertably receiving said top edge of said dividing wall when said lid is removably attached to said mug wherein said pair of ridges is configured to inhibit the fluid beverage in said first interior space from mixing with the fluid beverage in said second interior space, said mug having a recess extending into an outwardly facing surface of said perimeter wall of said lid, said recess extending around a full circumference of said perimeter wall, said recess being positioned closer to said lip of said lid than said basal wall of said lid, said lid having a pair of tabs each lying on top of said lip of said lid, each of said tabs extending outwardly beyond said lip wherein each of said tabs is configured to be gripped by the user for removing said lid from said mug, said pair of tabs being aligned with each other and being positioned on opposite sides of said lip with respect to each other;

a cover being rotatably attached to said lid, said cover being positionable in a first position having said cover being positioned over said first drinking hole wherein said cover is configured to inhibit the fluid beverage in said first interior space from passing through said first drinking hole, said cover being positionable in a second position having said cover being positioned over said second drinking hole wherein said cover is configured to inhibit the fluid beverage in said second interior space from passing through said second drinking hole, said cover having a first end and a second end and a pair of lateral edges each extending between said first end and said second end, each of said pair of lateral edges angling outwardly between said first end and said second end such that said second end has a width being greater than a width of said first end, said cover including a pivot being attached to an uppermost surface of said basal wall of said lid having said pivot being centrally positioned on said uppermost surface, said pivot being located adjacent to said first end of said cover such that said second end of said cover rests against said perimeter wall of said lid; and a gasket being positioned in said recess in said outwardly facing surface of said perimeter wall of said lid, said gasket being continuous such that said gasket extends around a full circumference of said recess, said gasket abutting said interior surface of said outer wall of said mug when said lid is removably attached to said mug, said gasket being comprised of a resiliently compressible material such that said gasket forms a fluid impermeable seal with said outer wall of said mug wherein said gasket is configured to inhibit the fluid beverage contained in each of said first interior space and said second interior space from escaping said mug when said lid is removably attached to said mug.

* * * * *